US006527646B1

(12) United States Patent
Briggs

(10) Patent No.: US 6,527,646 B1
(45) Date of Patent: Mar. 4, 2003

(54) COMPETITION WATER SLIDE

(76) Inventor: Rick A. Briggs, 64 Maple Grove, Springfield, IL (US) 62707

( * ) Notice: Subject to any disclaimer, the term of this patent is extended or adjusted under 35 U.S.C. 154(b) by 67 days.

(21) Appl. No.: 09/702,954

(22) Filed: Oct. 31, 2000

Related U.S. Application Data

(60) Provisional application No. 60/178,382, filed on Jan. 27, 2000.

(51) Int. Cl.[7] ..... A63G 21/18

(52) U.S. Cl. ..... 472/117; 472/128; 104/69

(58) Field of Search ..... 472/116, 117, 472/128, 137; 104/53, 69, 70

(56) References Cited

U.S. PATENT DOCUMENTS

| | | | | |
|---|---|---|---|---|
| 450,609 A | * | 4/1891 | Bormann | 104/56 |
| 4,145,042 A | | 3/1979 | Becker et al. | |
| 4,149,710 A | | 4/1979 | Rouchard | |
| 4,194,733 A | | 3/1980 | Whitehouse, Jr. | |
| 4,196,900 A | | 4/1980 | Becker et al. | |
| 4,484,739 A | * | 11/1984 | Kreinbihl et al. | 472/117 |
| 4,805,897 A | | 2/1989 | Dubeta | |
| 5,230,662 A | * | 7/1993 | Langford | 472/117 |
| 5,378,197 A | | 1/1995 | Briggs | |
| 5,453,054 A | | 9/1995 | Langford | |
| 5,503,597 A | | 4/1996 | Lochetefeld et al. | |
| 5,779,553 A | | 7/1998 | Langford | |
| 5,860,364 A | | 1/1999 | McCoy | |
| 6,060,847 A | | 5/2000 | Hettema et al. | |
| 6,186,902 B1 | | 2/2001 | Briggs | |

* cited by examiner

*Primary Examiner*—Kien T. Nguyen
(74) *Attorney, Agent, or Firm*—Jonathan A. Barney

(57) ABSTRACT

A competition water slide play apparatus is provided having a pair of water slide riding surfaces that are essentially mirror images of each other. These riding surfaces pass through a competition zone wherein the riding surfaces are substantially parallel to each other and first and second competition platforms are positioned adjacent the riding surfaces. Control stations are disposed on each of the competition platforms. Each control station corresponds to an aiding or a hindering play effect whereby a non-riding play participant can aid or hinder the travel of riding participants through the competition zone. The control stations on a first competition platform control aiding play effects in a first riding surface and hindering effects in a second riding surface. Similarly, the control stations on a second competition platform control aiding effects in the second ride surface and hindering effects in the first ride surface. In this manner, non-riding play participants are able to team up with riding play participants to help the riding participants on their respective team move through the competition zone faster than the competing ride participants.

27 Claims, 9 Drawing Sheets

COMPETITION WATER SLIDE

RELATED APPLICATIONS

This patent application claims priority to application No. 60/178,382 filed Jan. 27, 2000, the entirety which is hereby incorporated by reference.

BACKGROUND OF THE INVENTION

1. Field of the Invention

The present invention relates generally to the field of commercial play structures, and more particularly to a water slide play structure enabling competition between teams of play participants.

2. Description of the Related Art

Family-oriented theme parks and commercial recreational facilities are very popular. Water parks, in particular, have proliferated as adults and children alike seek the thrill and entertainment of water attractions as a healthy and enjoyable way to cool off in the hot summer months.

Water parks typically include a variety of water attractions. One of the most popular of such water attractions is the water slide. Commercial water slides typically include a riding surface having an entrance and an exit. The entrance is typically vertically higher than the exit and the riding surface slopes generally downwardly from the entrance to the exit.

One or more water outlets are usually provided adjacent the entrance and direct water onto the riding surface. The water provides a lubricant on the riding surface, reducing friction between the ride participant and the riding surface. Water also helps propel ride participants along the riding surface as the water flows downwardly with gravity. The volume of water on the riding surface can help to increase or decrease the speed of the participant riding along the riding surface. Additional water outlets may be interspersed at intervals along the length of the slide to provide additional lubricant and/or to accelerate the ride participant. Typically, ride participants exit the ride by splashing into a receiving pool.

A water slide support structure typically supports the riding surface and also includes a climbing structure or stairway which enables play participants to ascend to the entrance of the slide.

Typically, only one ride participant can slide down the slide at a time. Alternatively, groups can slide down together on a raft or the like. Water parks sometimes have a pair or more of water slides that have substantially similar paths from their entrances to their exits. Play participants have identified such similar slides as an opportunity to race each other, and will sometimes go to great lengths to begin their ride at exactly the same moment as a fellow play participant on an adjacent slide. While the racing play participants may enjoy this activity, the race remains largely an individual effort.

SUMMARY OF THE INVENTION

The present invention expands and improves upon these basic slide concepts by providing a water slide play structure wherein ride participants sliding on the water slide team up with participants on an adjacent support structure to achieve a common goal. The present invention also allows play participants on adjacent water slides to race each other to the bottom. Additionally, play participants that are not on the riding surface work as a team to help one group of racing ride participants travel through a competition zone of the water slide faster than an opposing group of ride participants.

In accordance with one aspect, the present invention comprises an interactive competitive water slide play structure. The structure has first and second water slides, each water slide comprising a start point, a finish point, and a path defined therebetween. The water slides conduct a flow of water along at least a portion of the path and convey a ride vehicle having at least one play participant riding thereon from the start point to the finish point. The first and second slides have substantially similar paths so that a first play participant riding on the first water slide can race a second play participant riding on the second water slide. Each water slide has at least one competition area defined between the start point and the finish point. The competition areas are substantially identical. Each competition area comprises a plurality of water effects. At least one water effect comprises an aiding effect adapted to promote ride vehicle progress through the competition area, and at least one water effect comprises a effect adapted to impede ride vehicle progress through the competition area. Each water effect has a corresponding actuator. A first control area is adapted to support at least one play participant. The first control area has a first aiding actuator adapted to trigger the aiding effect in a competition area of the first water slide and a first hindering actuator adapted to trigger the hindering effect in a competition area of the second water slide. A second control area is also adapted to support at least one play participant. The second control area has a second aiding actuator adapted to trigger the aiding effect in a competition area of the second water slide and a second hindering actuator adapted to trigger the hindering effect in a competition area of the first water slide. This arrangement enables play participants in the control areas to assist play participants riding on ride vehicles in corresponding water slides to race play participants riding an opposing ride vehicle.

In accordance with another aspect of the invention, a water slide play structure is provided for entertaining play participants. The play structure includes a water slide comprising a start point, a finish point, and a path defined therebetween. The water slide conducts a flow of water along at least a portion of the path and conveys a play participant riding along the path from the start point to the finish point. An aiding or hindering play effect promotes or hinders progress of the play participant riding along the path. An aiding or hindering effect controller actuates the aiding or hindering play effect.

In accordance with yet another aspect, a water slide play structure includes a water slide. The water slide comprises a start point, a finish point, and a path defined therebetween. The water slide conducts a flow of water along at least a portion of the path and conveys a play participant riding along the path from the start point to the finish point. A recirculation pool is positioned along the path between the start point and the finish point. The recirculation pool comprises a water recirculation system adapted to move water from a downstream end of the pool to an upstream end of the pool so that a current flows from the upstream end of the pool to the downstream end of the pool.

In accordance with still another aspect, a water slide play structure includes a water slide. The water slide comprises a start point, a finish point, and a path defined therebetween. The water slide conducts a flow of water along at least a portion of the path and conveys a play participant riding along the path from the start point to the finish point. A geyser is positioned along the path between the start point and the finish point. The geyser directs a stream of water upwardly from the path.

For purposes of summarizing the invention and the advantages achieved over the prior art, certain aspects and advantages of the invention have been described herein above. Of course, it is to be understood that not necessarily all such aspects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other aspects or advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

DETAILED DESCRIPTION OF THE PREFERRED EMBODIMENTS

Figure 1:
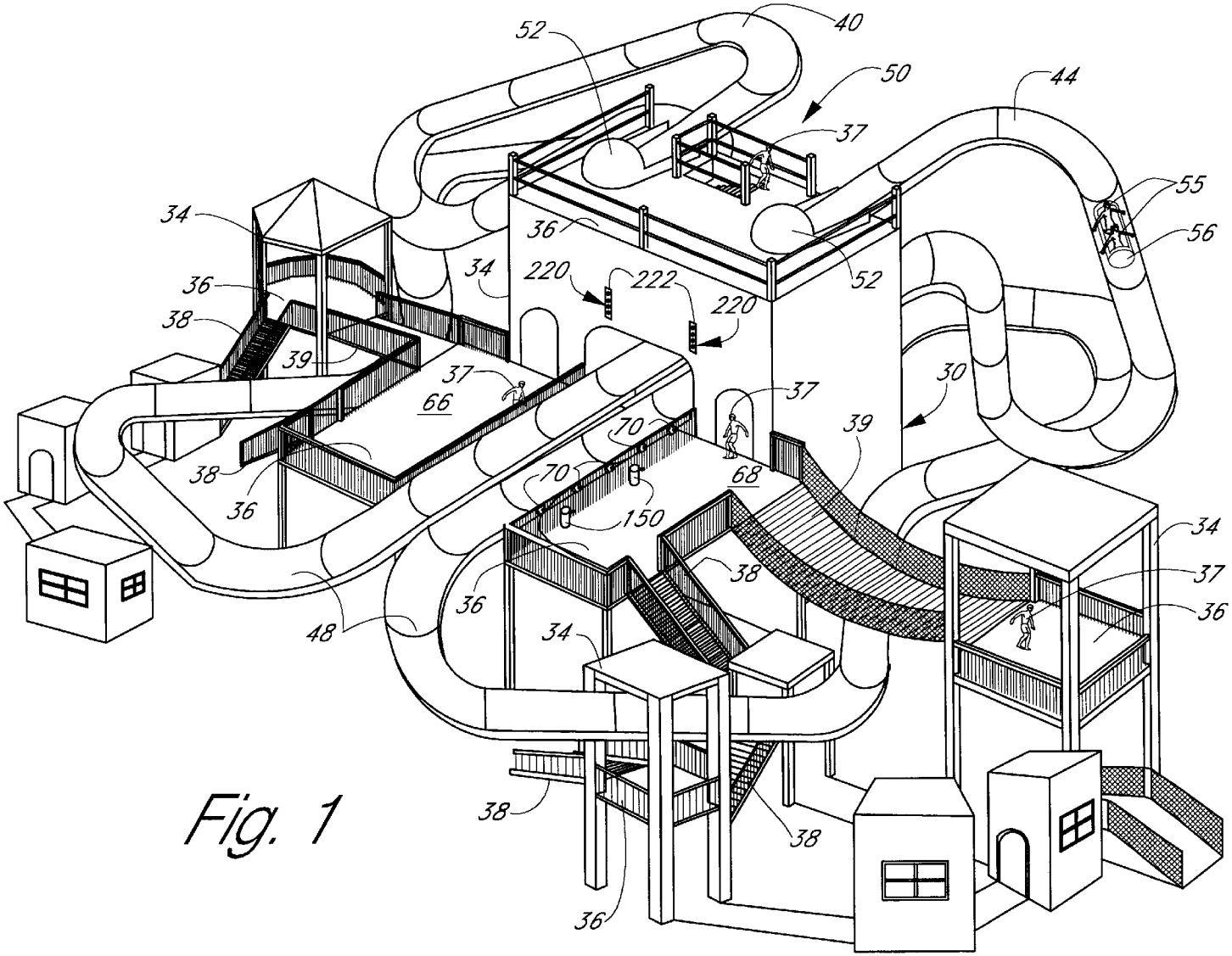
FIG. 1 is a perspective view of a play structure incorporating a competition water slide play apparatus in accordance with an embodiment of the present invention.

With reference first to FIG. 1, a play structure 30 is provided having a support structure 32 including a plurality of towers 34 having platforms 36 adapted to support play participants 37 playing thereon. The various platforms 36 can be accessed by stairs 38, bridges 39, climbing nets and the like, and provide numerous opportunities for the play participants to move about and enjoy themselves. The support structure 32 comprises commercially available building implements such as columns, girders, beams, pylons, and such. Conduits for transporting pressurized water are also provided within the structure 32.

The towers 34 are preferably designed and built in accordance with a theme, such as a castle, fort, firehouse, laboratory, fun house, jungle, or the like, or may reflect thematic elements from popular stories and/or animated movies and programs. The theme can be reflected in the structural make-up of the play structure and/or in graphical representations included on various graphical boards mounted on or adjacent the play structure 30.

Figure 2:
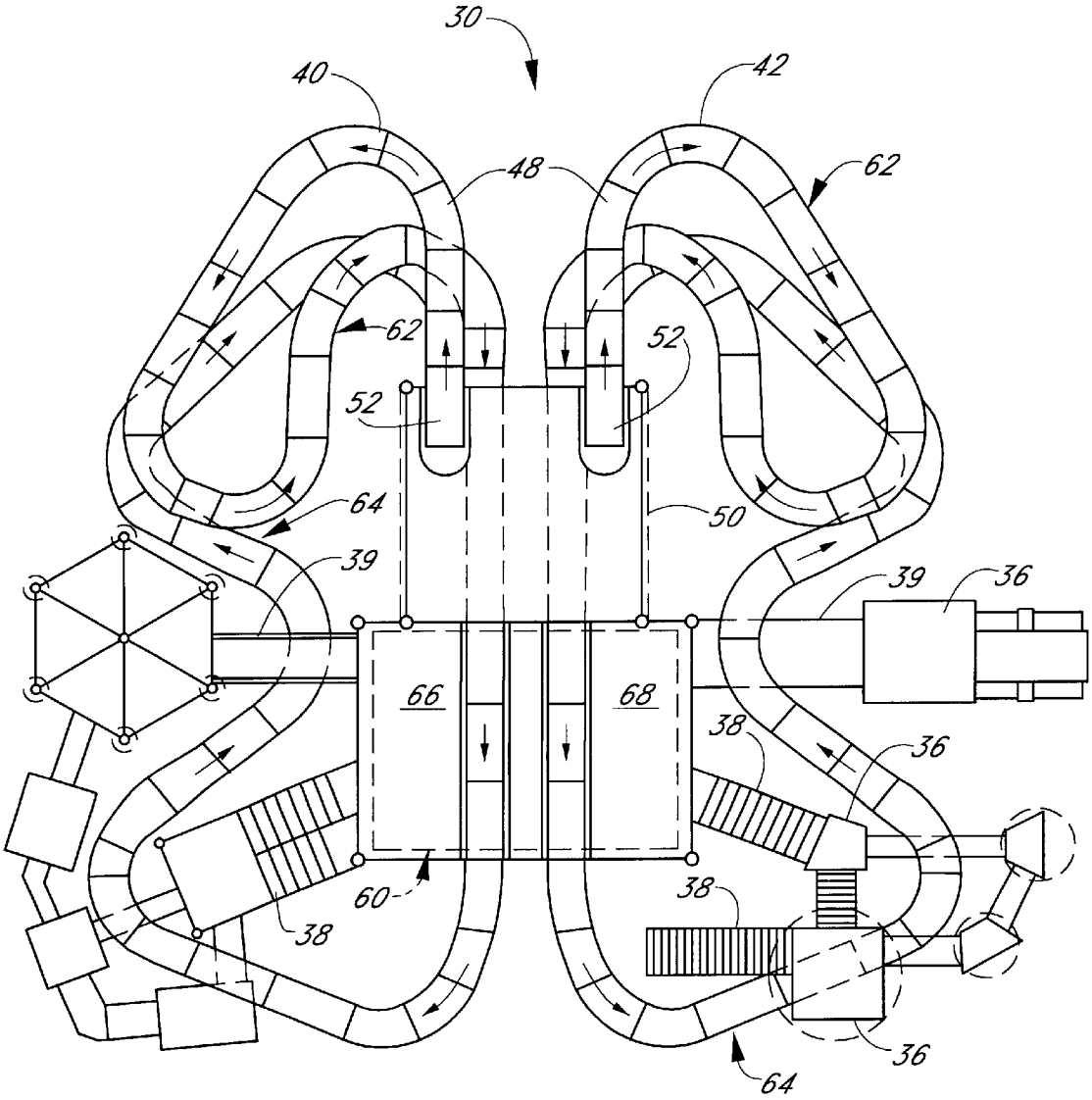
FIG. 2 is a schematic plan view of the competition water slide play apparatus of FIG. 1.

With reference also to FIG. 2, two water slides 40, 44 wind their way through the play structure 30. Each water slide 40, 44 comprises a riding surface 28 upon which ride participants may slide. The riding surfaces 48 are generally downwardly sloped along substantially their entire lengths, although upwardly-sloped or undulating variations are also possible. A main support tower 50 preferably supports an entrance 52 of each water slide 40, 44 and a flow of water W is directed onto each riding surface 48 adjacent the entrance 52 both to lubricate the ride surface 48 and to help propel ride participants down the water slide 40, 44 to an exit located near the bottom of the play structure.

As best shown in FIG. 2, the first and second water slides 40, 44 are substantially mirror images of each other. In this manner, participants sliding down opposing slides can compete or race with one another with the confidence that each participant is encountering generally the same slide design. This gives participants the feeling that they are competing on equal footing.

In the illustrated embodiment, a group of one or more ride participants 55 ride a raft 56, tube or other conveyance down the riding surface 48. Various towers 34 and platforms 36 are positioned immediately adjacent certain portions of the slide to allow play participants 37 that are not sliding along the ride surface 48 to view and perhaps interact with ride participants 55 sliding upon the ride surfaces. In addition, various play activities related to or unrelated to the water slides 40, 44 may be housed in the various towers 34 and platforms 36.

A competition zone 60 is defined between an upper section 62 and a lower section 64 of the water slide 40, 44. In the competition zone 60, the first and second water slides 40, 44 are positioned substantially parallel to each other, and the speed of the water flowing down the riding surface 48 is substantially reduced. First and second platforms 66, 68 are provided adjacent the water slides 40, 44 in the competition zone 60. These competition platforms 66, 68 support non-riding competition play participants 37, who can work to aid or hinder ride participants as the ride participants traverse the competition zone 60.

As will be discussed in more detail below, non-riding competition participants on the competition platforms 66, 68 can operate one or more control stations 70 to actuate play effects that may either help or hinder the ride participants making their way through the competition zone 60.

The control stations 70 and play effects are generally arranged so that the non-riding competition participants on the first platform 66 actuate play effects to aid ride participants on the first water slide 40 and hinder ride participants on the second water slide 44. Similarly, control stations 70 and play effects on the second competition platform 68 are arranged so that non-riding competition participants on the second competition platform 68 actuate play effects to generally help the ride participants 55 in the second water slide 44 traverse the competition zone 60 and generally hinder ride participants 55 in the first water slide 40. In this manner, non-riding competition participants team up with corresponding riding participants to win a race through the competition zone 60. Of course, winning the race through the competition zone 60 can help the ride participants win the overall race to the exit or to a finish line of the water slide 40, 44.

The speed of ride participants as they make their way along the water slide 40, 44 through the competition zone 60 is preferably relatively slower than the speed at other portions of the water slide. Having the ride participants move through the competition zone 60 relatively slowly provides more of an opportunity for non-riding competition participants to aid and hinder the riding participants. It also enables the aiding and hindering effects to be more noticeable and thus more enjoyable to all the participants. However, to preserve participant throughput, it is important that riding participants do not permanently stop in the competition zone 60. Accordingly, a means is provided for regulating movement of the ride participants through the competition zone 60 so that substantially constant movement is maintained even though aiding and hindering effects may affect the speed of movement.

Figure 3:
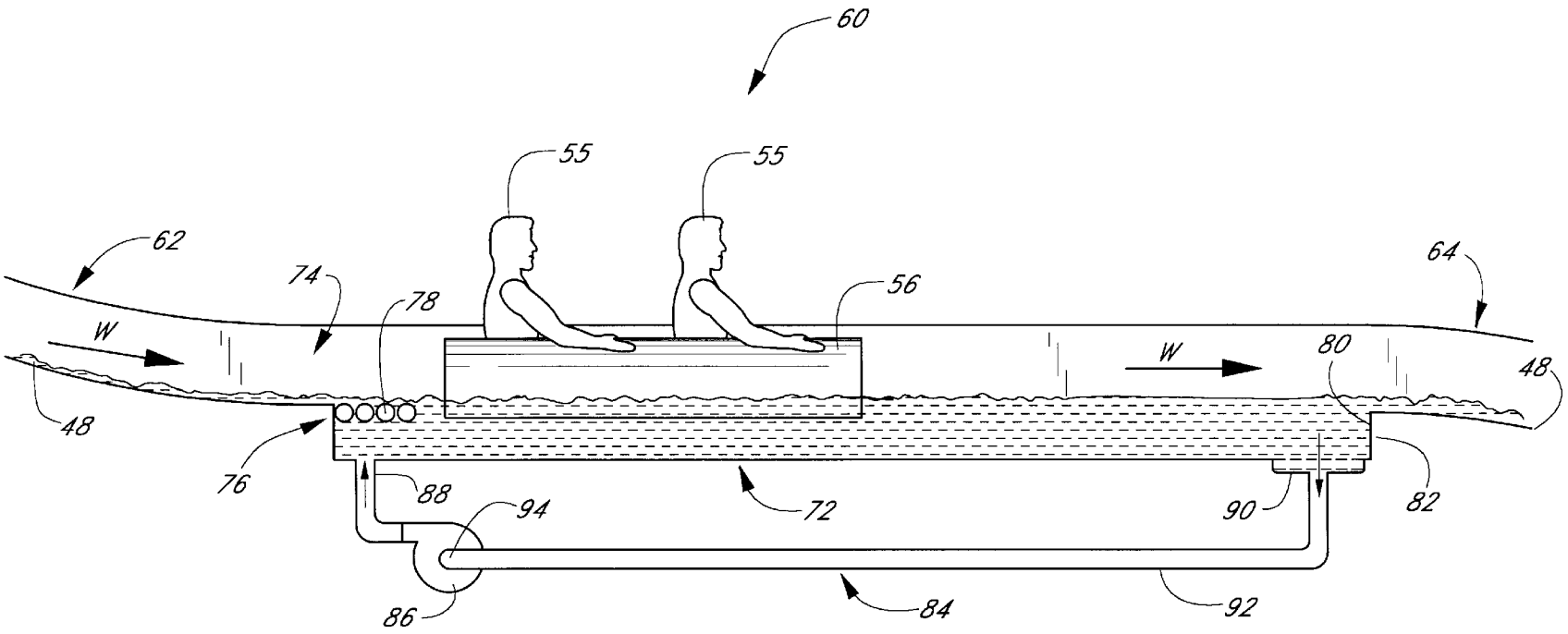
FIG. 3 is a side schematic view of a competition zone of the competition water slide of FIG. 2.

With next reference to FIG. 3, each water slide 40, 44 preferably includes a relatively deep-water portion 72 provided in the competition zone 60. A transition zone 74 is provided at the upstream end 76 of the deep-water portion 72 and preferably comprises rollers 78 or the like so that a raft 56 sliding from the upper sliding section 62 transitions rather smoothly into the deep portion 72, where the raft 56 floats. A downstream weir 80 is provided at a downstream end 82 of the deep portion 72. Water flows over the downstream weir 80 and draws the raft 56 and ride participants into the lower portion 64 of the slide 40, 44.

To maintain water flow W at a desired speed, a recirculation system 84 is preferably provided in the competition zone 60. A recirculating pump 86 delivers a flow of water through a port 88 into the upstream end 76 of the deep portion 72. A drain 90 adjacent the downstream weir 80 is connected by a pipe 92 to an input end 94 of the recirculation pump 86 so that water is pumped from the downstream end 82 of the deep portion to the upstream end. As a result, a current runs from the upstream end 72 of the competition zone 60 to the downstream end 82 of the competition zone 60. Riding participants in their rafts 56 float with the current through the competition zone 60. At the downstream end 82 of the competition zone 60, the raft 56 proceeds over the weir 80.

As mentioned above, aiding and hindering water effects are disposed within the competition zone 60 of each water slide 40, 44. The aiding effects are adapted to help the ride participants advance through the competition zone 60. The hindering effects are adapted to retard participants' progress through the competition zone.

Figure 4:
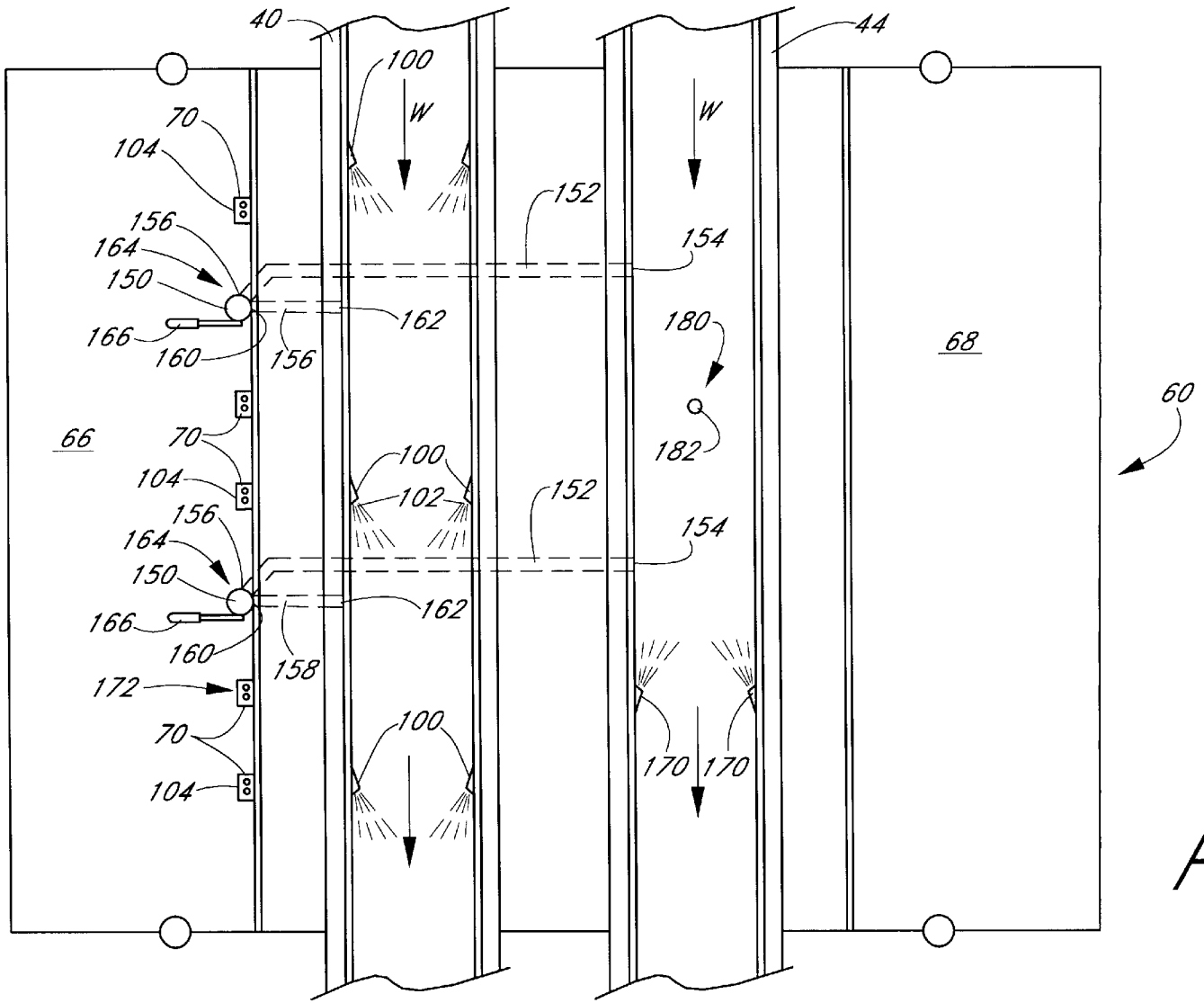
FIG. 4 is a schematic top view of the competition zone of the competition water slide of FIG. 2.

In order to more clearly describe the structure of the competition zone 60, and for ease of illustration, FIG. 4 shows only control stations 70 on the first competitive platform 66 and their associated play effects. Thus, aiding effects are illustrated only in the first water slide 40, while hindering effects are illustrated only in the second water slide 44. It is to be understood, however, that similar control stations 70 are also provided on the second competitive platform 68 and correspond to similar aiding and hindering play effects in the second and first water slide 44, 40, respectively. In order to keep competition between the water slides on equal footing, the aiding and hindering play effects in the first and second slides 40, 44 are substantially identical to each other in the competition zone 60.

The preferred hindering and aiding effects will now be described with reference to the control stations 70 on the first platform 66. Push jets 100 are disposed in the sides 40 of the first slide within the competition area 60. The push jets 100 comprise push jet nozzles 102 connected to a source of water under pressure. The push jet nozzles 102 are preferably angled to shoot a stream of water W substantially downstream in a manner to contact the end or sides of a passing raft 56 so as to help push the raft 56 downstream. The push jets 100 are preferably arranged in pairs, with nozzles 102 on opposing sides of the water slide 40. In the illustrated embodiment, three spaced-apart pairs of push jets 100 are arranged within the competition zone 60.

Figure 5:
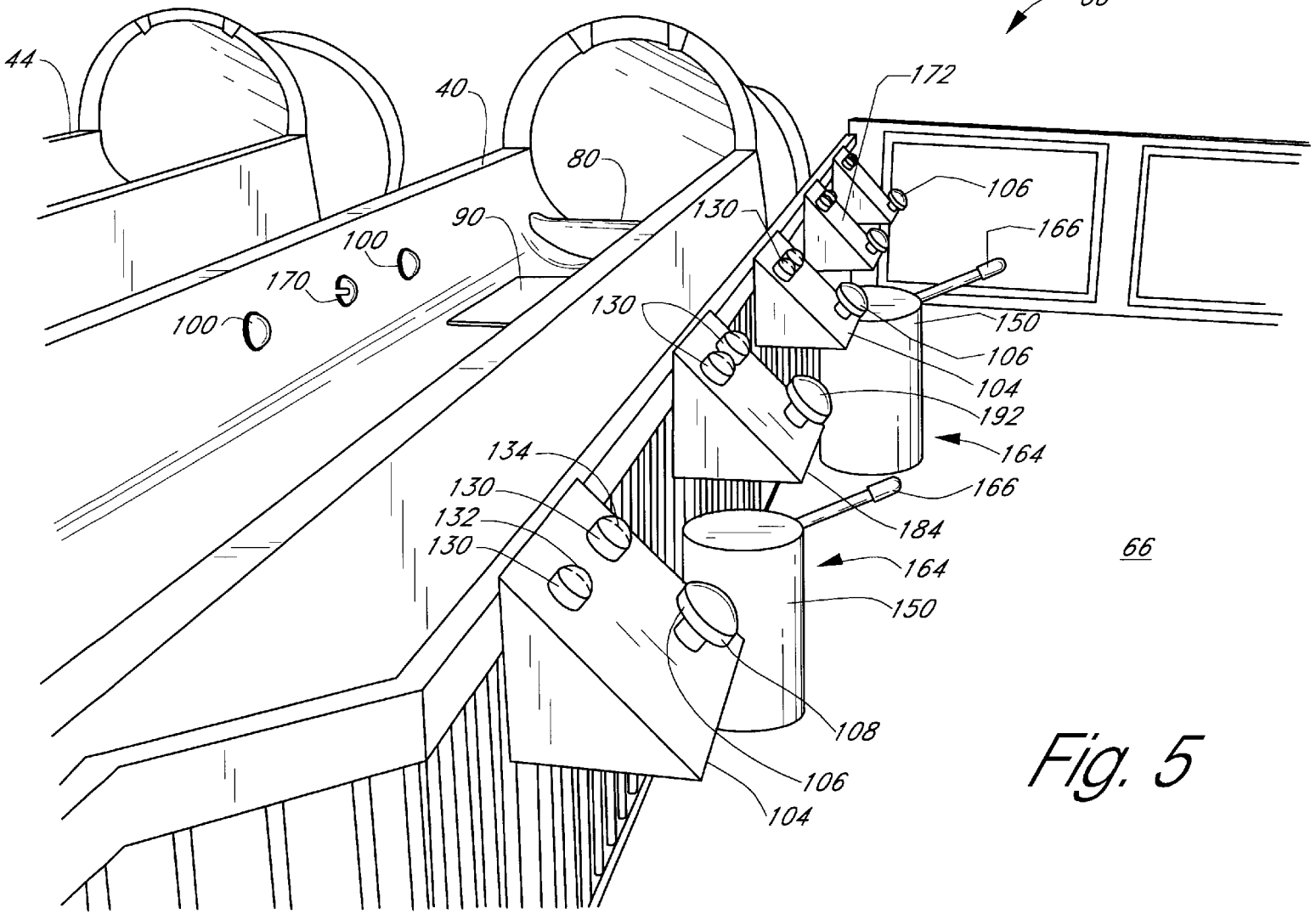
FIG. 5 is a perspective view of a portion of a platform area and water slide within the competition zone of the competition water slide of FIG. 2.
Figure 6:
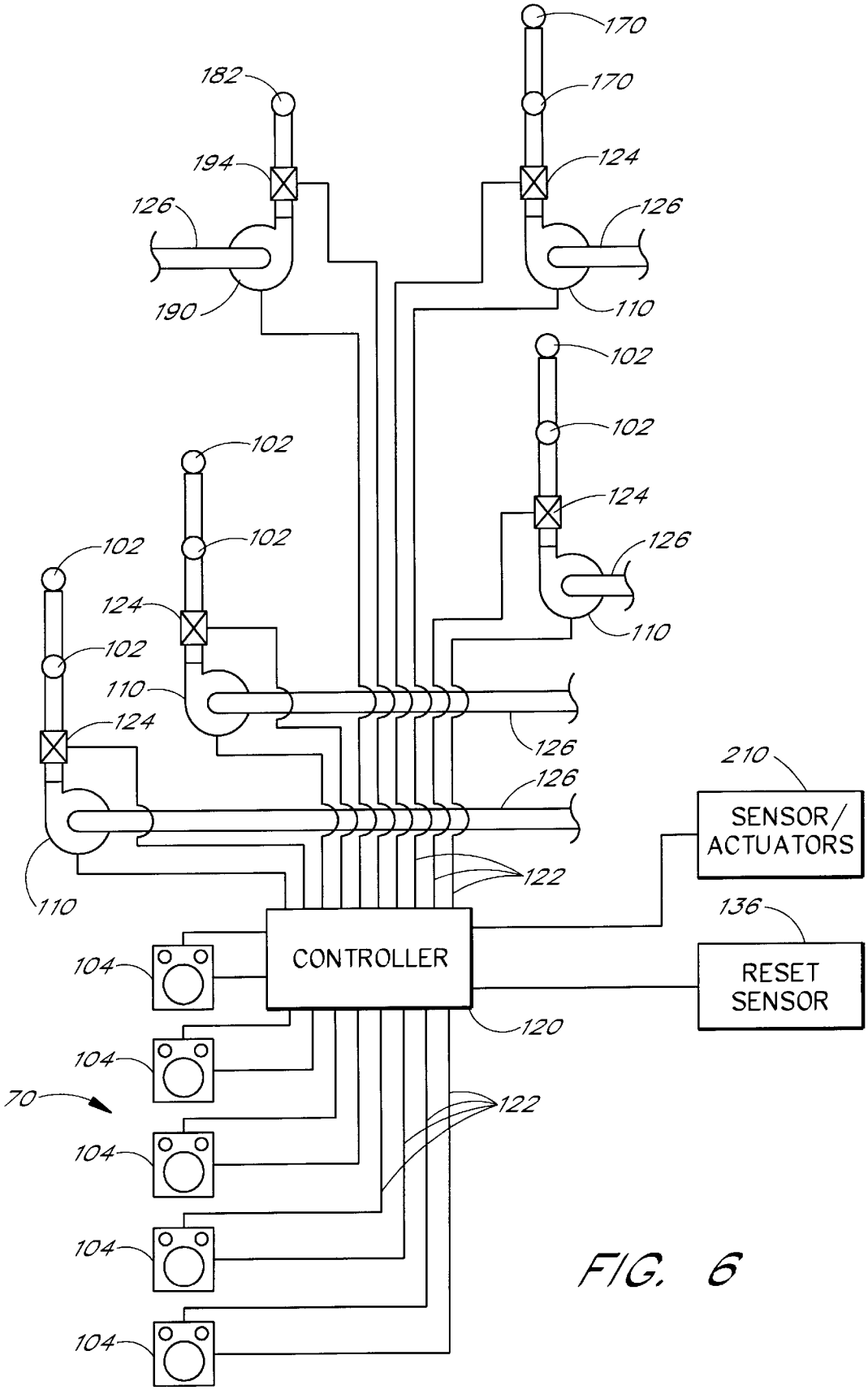
FIG. 6 schematically shows a control system for use in accordance with an embodiment of the present invention.

With reference also to FIGS. 5 and 6, each pair of push jets 100 is preferably controlled by a corresponding push jet control station 104. Each push jet station 104 preferably includes a push jet actuator 106, which is adapted to trigger the push jets 100. The push jet actuator 106 may comprise any number of actuators including, for example, a push button, a light sensitive diode adapted to actuate the push jets when ambient light is blocked by a play participant, a handle, lever or any known means for actuating the effect. The illustrated embodiment shows a push button actuator 108.

FIG. 6 sets forth a schematic operating diagram of the push jet system. As shown in the figure, each pair of push jets 100 preferably communicates with a dedicated variable-speed pump 110. The operating speed of each pump 110 is controlled by an electronic controller 120 which communicates electronic signals to the pumps 110 through electronic control lines 122. In some additional embodiments, a valve 124 is disposed between the pump 110 and the corresponding push jets 100. The valve 124 preferably comprises an electronically operated valve, such as a solenoid valve. The pumps 110 receive water from a supply line 126 and pressurize the water before delivering it to the push jets 100.

In a preferred embodiment, the pumps 110 run substantially continuously during operation so that a substantially continuous flow of water flows from each of the push jets 100. In this manner, the push jets 100 will always aid the raft 56 moving through the competition zone 60. When the push jet actuator 106 is actuated by a participant, a signal is transmitted to the controller 120, which in turn signals the corresponding pump 110 to increase the pumping volume. Thus, actuating the actuator increases the water volume and pressure dispensed by the push jets 100, which correspondingly increases the aiding effect of the push jets 100 on the passing raft 56. Of course, it is to be understood that the push jets 100 need not be continuously running. In additional embodiments, the push jets may be adapted to run only when the actuator 106 is actuated.

It is also to be understood that various control mechanisms can be employed for varying the amount and/or velocity of water delivered by the push jets 100. For example, rather than varying the speed of the pumps 110, the controller can send a message to the electronically-actuatable valve 124 to vary the opening of the valve. Thus, the volume of water delivered by the corresponding push jets 100 can be regulated by controlling the opening of the valve 124. Still further, the controller 120 can use both variation of pump speed and valve opening to control the amount of water delivered through the push jets 100.

It is also to be understood that various arrangements of pumps 110 and valves 124 can be used as desired. For example, instead of having a dedicated variable-speed pump 110 for each pair of push jets 100, a single pump may provide pressurized water to all of the push jets, and even to all or most of the water effects in the competition zone 60. The volume of water delivered to each effect can then be regulated by electronically-controlled valves 124.

The push jets 100 are preferably adapted to be actuatable only for a specified period of time, for example, 1–5 seconds, or more preferably about 3 seconds. After the period of actuation, the push jets 100 become inoperable until another raft 56 enters the competition zone 60.

Accordingly, the push jet control stations 104 preferably include indicators 130 to communicate whether or not the push jets 100 are available for use.

As shown in FIG. 5, a red indicator light 132 may shine when the push jets 100 are "unarmed" and inoperable; a green indicator light 134 may be lit when the push jets 100 are "armed" and available for use. By limiting the length of time that the push jets 100 can be actuated, their effectiveness is at least partially dependent upon the timing of the play participant that actuates the jets. Thus, a play participant is able to employ a level of skill in aiding the raft 56 on the slide 40. Of course, it is not required to limit the period of time that the push jets 100 may be operable.

With reference again to FIG. 6, once the push jets 100 have been actuated for the prescribed period of time, the controller 120 will signal the pump 110 to reduce volume and signal the control station 104 to light up the red light 132 to indicate that the push jet actuator 106 is unarmed. At this time, the controller 120 will not respond to signals sent by the push jet actuator 106.

A reset sensor 136 is preferably provided upstream of the competition zone 60 and is adapted to detect when another raft 56 is about to enter the competition zone 60. When the reset sensor 136 detects such a raft 56, a signal is transmitted to the controller 120, which in turn signals the control station 104 to light up the green light 134, thus indicating that the actuator 106 is now armed. At this time, the controller 120 will respond to signals from the actuator 106 of the control station 104. It is to be understood, however, that rather than depending on a reset sensor 136 upstream of the competition zone 60, the controller 120 may be adapted to automatically reset the push jet actuator 106 after a prescribed period of time of, for example, 2 to 10 seconds, or more preferably about 5 to 7 seconds.

Figure 7:
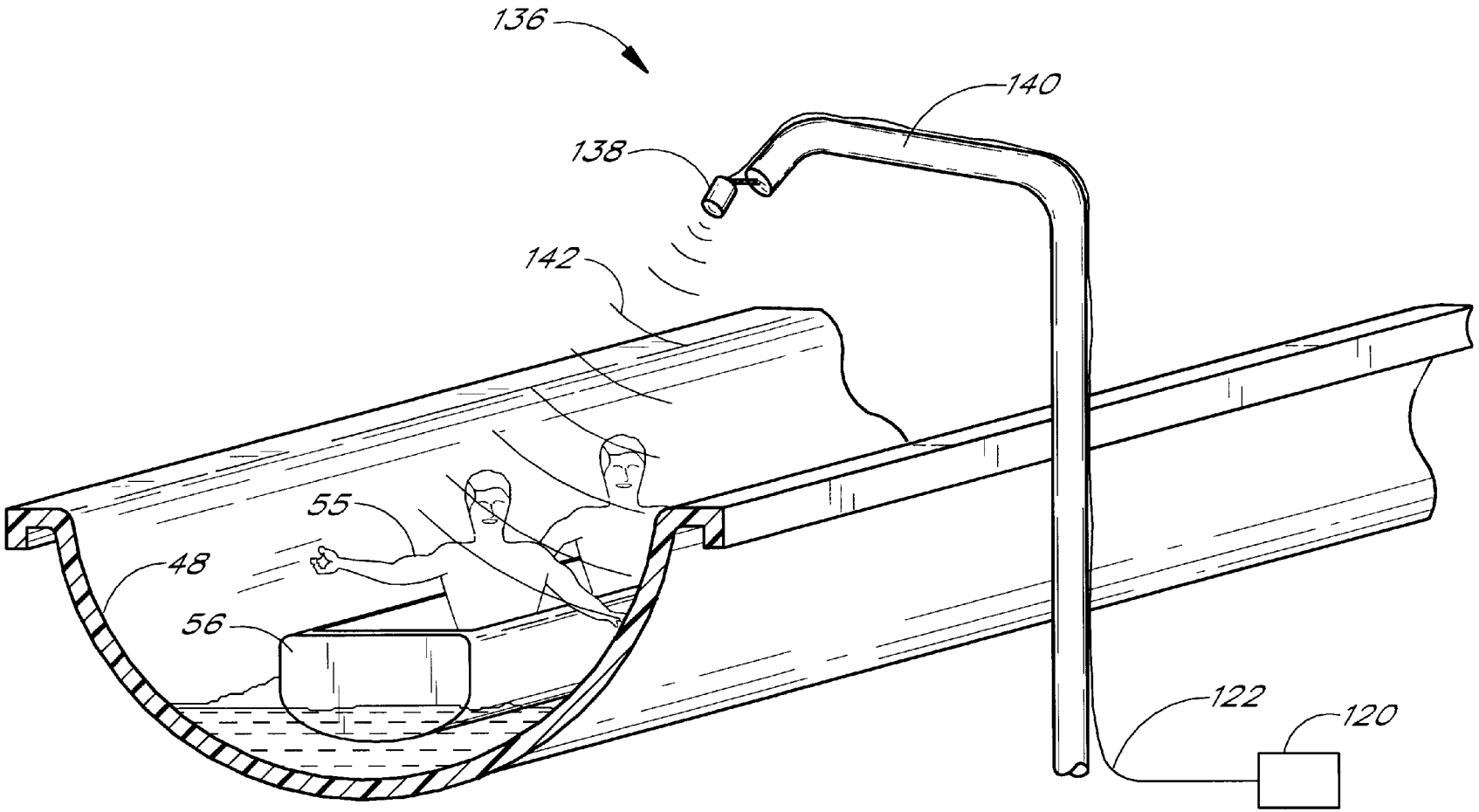
FIG. 7 shows a perspective view of a motion sensor for use in another embodiment of the present invention.

With next reference to FIG. 7, a simplified schematic illustration of one embodiment of a reset sensor 136 device is shown. In FIG. 7, the reset sensor 136 comprises a motion detector 138 mounted above the riding surface 48 on an overhead beam 140. The motion detector 138 can comprise any one of a variety of commercially available motion sensing devices well known to those skilled in the art, such as those used to automatically open and close doors in commercial buildings or to turn lights on and off. In one possible mode of operation, the motion detector 138 uses a sensing beam 142 which is reflected back to the motion detector 138 when an object, such as ride participants on a raft 56, enters the area of the sensing beam 142. The sensitivity of the motion detector 138 can be varied as desired to adjust the level of motion required to trigger the motion detector 138. Alternatively, the motion detector 138 may comprise an infrared sensor which senses the body heat of a ride participant.

Upon activation, the motion detector 138 generates an activating signal which is transmitted to the controller 120 as discussed above. Those skilled in the art will readily appreciate that a wide variety of other detectors may be used in order to detect ride participants that are about to enter the competition zone 60.

With reference again to FIG. 4, a pair of displacement pumps 150 are provided on the first competition platform 66. Each displacement pump 150 has a supply pipe 152 extending from a drain 154 in the second slide 44 to a pump input 156, and a delivery pipe 158 extending from a pump outlet 160 to a first slide inlet port 162. The displacement pump 150 is controlled at a displacement pump station 164 and preferably comprises a bellows-type pump 150 manually actuatable by a play participant operating a handle 166. In operation, the bellows pump 150 transports water from the second slide 44 to the first slide 40, thus increasing the volume of water on the first slide 40. This increased water volume increases the current flow, thus aiding the ride participants in the first slide 40. Similarly, decreasing the volume of water in the second slide 44 decreases the current, thus slowing down a raft 56 in the second slide 44. In this manner, the displacement pump 150 allows a first competition participant to simultaneously aid ride participants on the first slide 40 and hinder ride participants on the second slide 44.

It is to be understood that other orientations of the displacement pump 150 may also be used. For example, rather than transferring water from one slide to another slide, the displacement pump 150 may be configured to draw water from the downstream drain 90 of the deep portion 72 of the competition zone 60 and transfer that water to a port adjacent the upstream port 88 of the deep portion 72. With such a configuration, the displacement pump works in conjunction with the recirculation pump to increase the current through the deep portion 72.

A pair of reverse jets 170 are oriented in the second water slide 44 and are positioned so as to direct a stream of water in a generally upstream direction. The reverse jets 170 are controlled at a reverse jet station 172 on the first platform 66 and operate substantially similarly to the push jets 100 except that the reverse jets 170 are configured to hinder, rather than help, a raft 56 sliding down the second slide.

With reference again to FIG. 6, the reverse jets 170 preferably function and are controlled in a manner similar to the push jets 100 as described above. However, the reverse jets 170 preferably do not run continuously and are adapted to operate for only a limited time of, for example, one to five seconds, or more preferably about three seconds. The time limit is provided so that the reverse jets 170 will not hold up raft progress for very long. Thus, while the reverse jets 170 can hinder a ride participant trying to move through the competition zone 60, they will not permanently bar progress through the competition zone.

Figure 8:
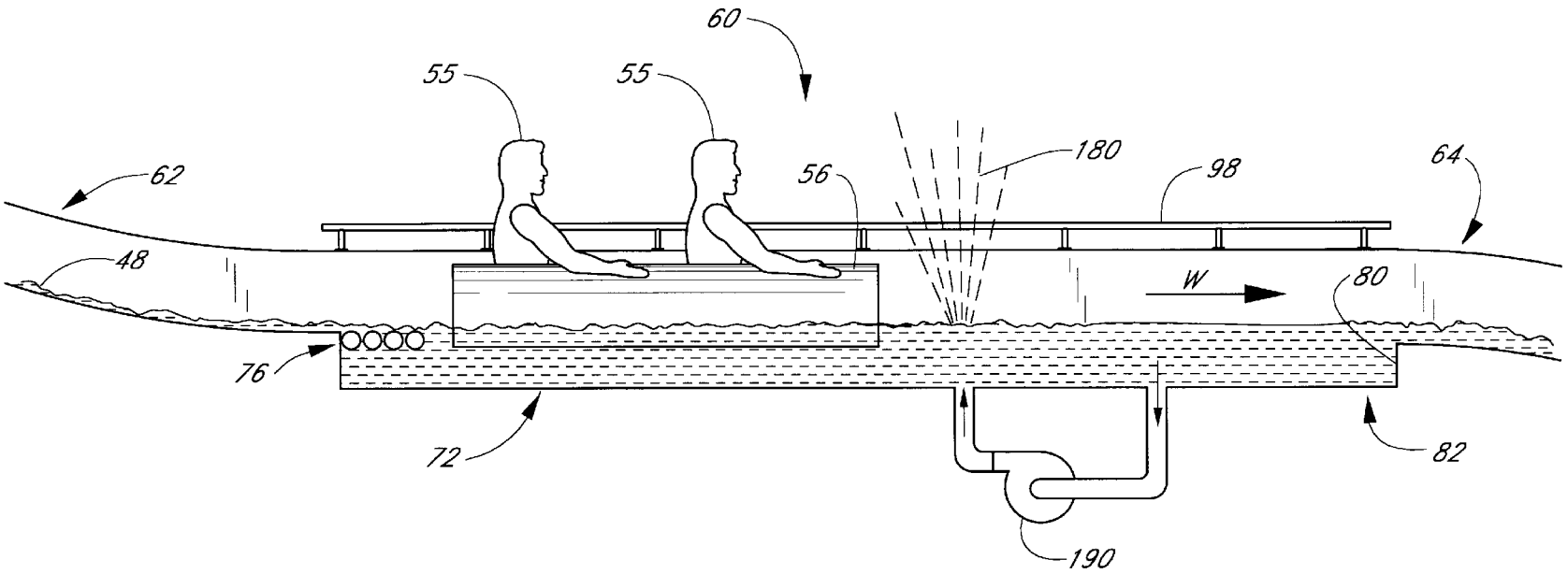
FIG. 8 is a schematic side view of a water slide competition zone showing a geyser play effect.

With specific reference to FIGS. 4, 6 and 8, a geyser jet 180 is provided in the second slide 44 within the competition zone 60. The geyser jet 180 preferably comprises a nozzle 182 connected to a source of water under pressure and oriented to shoot upwardly from the bottom of the slide 44. This geyser jet effect will hinder and harass ride participants in the second slide 44. Preferably, the geyser jet 180 is controlled at a geyser jet station 184 on the first competition platform 66, and is actuatable by play participants on the first platform 66.

As shown in FIG. 6, the geyser jet 180 is preferably powered by a pump 190 which pressurizes water received from a water source and delivers it to the geyser nozzle 182. As with the play effects discussed above, when a competition participant actuates a geyser jet actuator 192, a signal is transmitted to the controller 120, which correspondingly triggers the geyser jet pump 190. Alternatively, or in addition, the controller 120 can signal an electromechanical valve 194 in order to control geyser jet actuation.

Any number of other hindering or aiding effects can be arranged in the competition area 60. These effects may comprise water effects, such as those described above, or may even comprise mechanical effects, such as, for example, a spinning wheel that will help push the raft along, a rope pull, or the like.

In an additional embodiment illustrated in FIG. 8, grab rails 198 are provided adjacent the slides 40, 44 in the competition zone 60. The grab rails 98 allow riding participants on the raft 56 to pull themselves through the competition zone 60. The grab rails 98 may be rigidly mounted so as to be permanently available to the ride participants or may be retractable so as to be selectively accessible only if the ride participants satisfy certain requirements. For example, an actuator near the top of the slide may trigger a hydraulic actuator that moves the grab rails 98 from a retracted position to the available position shown in FIG. 8. The ride participants must affirmatively trigger the actuator in order to have the grab rails available to them as they move into the competition zone 60. It is to be understood that the grab rails 98 can also be moved into place in any manner known in the art, such as by an electrical or mechanical linkage.

The hindering and aiding effects enable play participants on the first platform 66 and ride participants on the first water slide 40 to work together to win a race against ride participants on the second water slide 44. Simultaneously, play participants on the second platform 68 work with the ride participants in the second water slide 44 to race against ride participants on the first water slide 40. In this manner, participants on and off of the slides 40, 44 work together as a team in competition with another team of play participants.

Although the play structure 30 has been disclosed herein as only having a pair of water slides 40, 44, it is to be understood that any number of water slides can employ the principles discussed herein to have a competition between the riding participants moving along the water slides. Additionally, various orientations of the water slides can be advantageously used. For example, the water slides can be arranged to flow in opposite directions through the competition zone so that ride participants can affirmatively face their competition during at least a portion of the ride through the competition zone.

Figure 9:
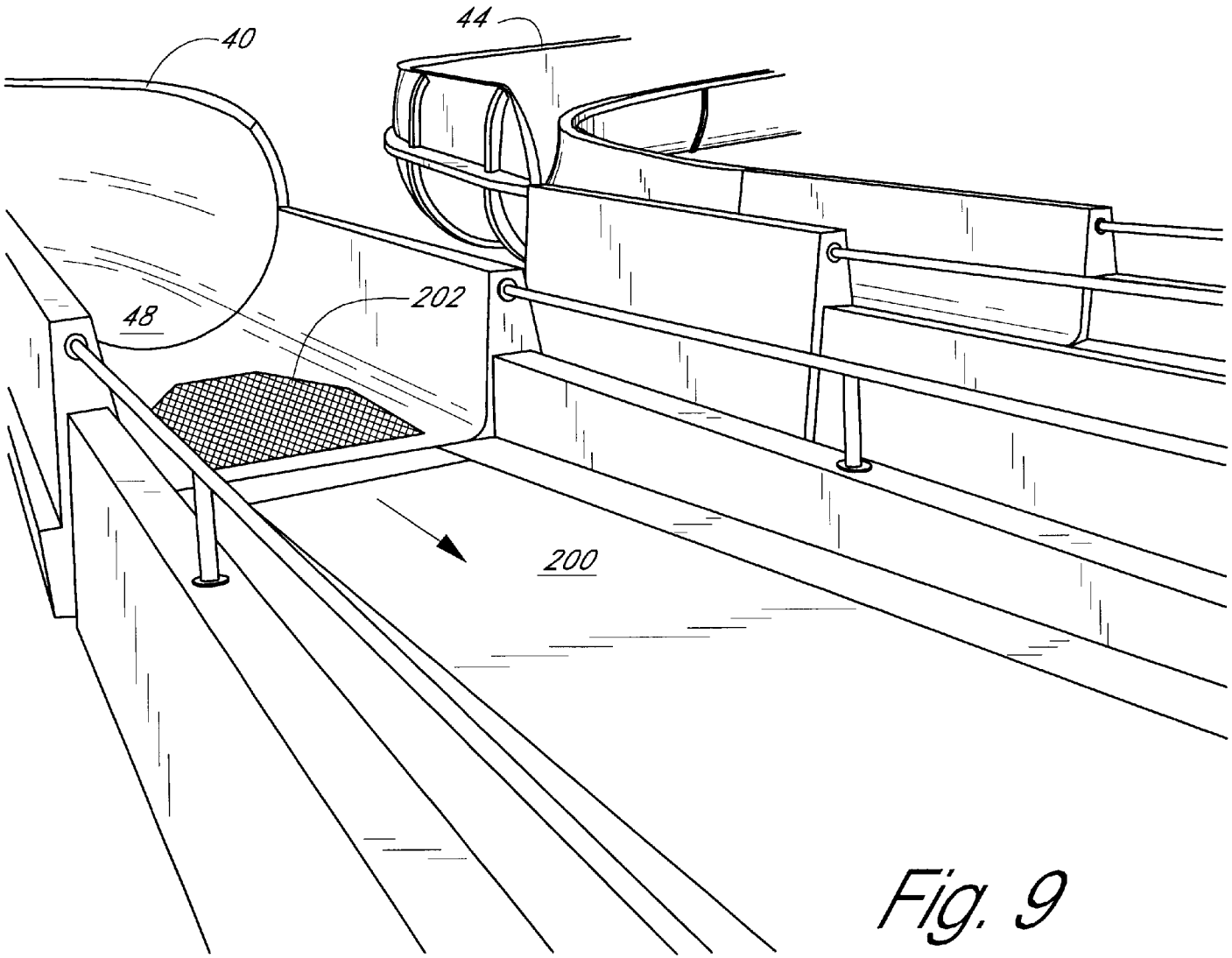
FIG. 9 is a perspective view of an end portion of the water slide play structure of FIG. 2.

After the ride participants make their way through the competition zone 60, they move onto the lower section 64 of the water slide riding surface 48 and negotiate various turns until passing a finish line. After reaching the finish line, the raft 56 is deposited into a splash pool or, more preferably, settles onto a conveyor 200. With next reference to FIG. 9, a drain 202 is positioned at the downstream end of the water slide 40, 44. The conveyor 200 is positioned adjacent the drain 202. As a raft 56 carrying ride participants reaches the downstream end of the water slide, the water flows down the drain 202 and the raft 56 is deposited onto one end of the conveyor 200. The conveyor 200 transports the raft 56 and its associated ride participants away from the downstream end of the water slide 40, 44.

In an additional embodiment, the riding participants are able to actuate certain actuators and signals in order to increase the power and/or effectiveness of various hindering and aiding effects. These actuators can be accessible and actuatable by ride participants on the ride surface 48. For instance, play participants can trigger certain actuators by affirmatively touching a button adjacent the ride surface, blocking ambient light surrounding a diode sensor, triggering a motion sensor, contacting a target or paddle above or adjacent the ride surface, or the like. When triggered, the actuator will transmit a signal to the controller, which in turn sends signals to enhance or inhibit various effects. These sensor/actuators are represented by schematic block 210 in FIG. 6.

Some sensor/actuators will be automatically triggered every time a ride participant passes thereby. Other sensors, however, can be selectively actuated by play participants. This means that play participants must move their arms, legs, or other body parts to make an affirmative effort to actuate the sensor. Once actuated, however, the sensor will trigger certain beneficial effects. For example, if a ride participant actuates a target actuator on the upper portion of the slide, a signal is transmitted to the controller 120 to increase the volume and/or power of the stream of water dispensed by one or more pairs of the push jets 100. Similarly, triggering another sensor may transmit a signal directing the high flow duration or water pressure of the push jets 100 or other effects to be increased. Additionally, and as discussed above, actuating. certain sensors may signal grab rails 98 to hydraulically move into a position where they are accessible to ride participants. Still further, actuation of another sensor may trigger a play effect that sprays water or other play media at play participants on the opposing platform.

In yet another additional embodiment, one or more hindering sensor/actuators are provided on or adjacent the upper section 62 of the water slide 40, 44. These sensors trigger effects that actually hinder the ride participants on that slide. Thus, ride participants will learn to affirmatively avoid actuating such sensor/actuators. The sensors are preferably positioned so that the ride participants can avoid actuating them either by resisting the urge to reach out and trigger the actuator or by using some affirmative effort to avoid triggering the actuator. For example, an infrared sensor may be directed across the riding surface at a height such that if ride participants duck their heads, they will avoid interrupting the beam and actuating the sensor, but if participants do not duck down, they will actuate the sensor which, in turn, will actuate some hindering effect such as decreasing the flow volume of the push jets or increasing the flow volume of the push jets for their competing riding participants.

In yet another additional embodiment, a motion sensor (not shown) or other type of sensor is located at the downstream end 82 of the competition zone 60 of each slide 40, 44. This sensor is actuated automatically when the riders and raft 56 pass thereby. As can be understood, the team farthest ahead in the race will actuate the sensor first. When the leading ride participant team actuates the sensor, a water effect is actuated which pours or otherwise directs water onto non-riding competition participants on the platform 66, 68 competing against the leading team. In this manner, the losing team or teams are punished for allowing their teammate ride participants to lose or fall behind in the race through the competition zone 60. This provides extra motivation and intensity to the efforts of the non-riding competition participants.

The punishing water effect can be of any kind. For example, a bar jet 220 comprising a hollow bar connected to a source of water under pressure and having a series of nozzles 222 attached thereto, can be attached to the play structure 30; each of the nozzles 222 is adapted to direct a spray of water generally in the direction of each of the control stations 70 on the losing competition platform.

It is to be understood that various other effects can be used to "punish" the losing teams. For example, visual or aural effects may be triggered to reward the winners and punish the losers.

In yet a further embodiment having features in accordance with the present invention, non-riding participants may play only a minimal role, or no role, in aiding or hindering riding participants; however, riding participants may be able to trigger, through various actuators disposed on the riding surface or actuatable by a nonparticipant on the ride surface, aiding and hindering effects. Thus, by actuating or avoiding actuation of certain sensors adjacent the ride surface 40, riding participants can enhance the speed of their own travel down the water slide while inhibiting the speed of travel of their competitors.

In a still further embodiment, a display is provided to show ride participants' elapsed time for traveling from the start point to the finish point of the slide. The display is preferably digital. Additionally, the display can be adapted to store and display record-setting race times. Thus, ride participants may work toward the goal of breaking or setting a record for the fastest time of the year, the month, week, day, hour, or all time. Visual and/or aural effects can be provided to indicate newly-set records.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or subcombinations of the specific features and aspects of the embodiments may be made and still fall within the scope of the invention. Accordingly, it should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. An interactive competitive water slide play structure for entertaining play participants, comprising:

first and second water slides, each water slide comprising a start point, a finish point, and a path defined therebetween, the water slides adapted to conduct a flow of water along at least a portion of the path and to convey a ride vehicle having at least one play participant riding thereon from the start point to the finish point;

the first and second slides having substantially similar paths so that a first play participant riding on the first water slide can race a second play participant riding on the second water slide;

each water slide comprising at least one competition area defined between the start point and the finish point, the competition areas configured to be substantially identical and adapted so that the ride vehicle progresses therethrough, each competition area comprising:

a plurality of water effects comprising water forming elements, wherein at least one water effect comprises an aiding effect adapted to promote ride vehicle progress through the competition area, and at least one water effect comprises a hindering effect adapted to impede ride vehicle progress through the competition area, each of the water effects having a corresponding actuator;

a first control area adapted to support at least one play participant and having a first aiding actuator adapted to trigger the aiding effect in a competition area of the first water slide and a first hindering actuator adapted to trigger the hindering effect in a competition area of the second water slide; and a second control area adapted to support at least one play participant and having a second aiding actuator adapted to trigger the aiding effect in a competition area of the second water slide and a second hindering actuator adapted to trigger the hindering effect in a competition area of the first water slide;

wherein play participants in the control areas assist play participants riding on ride vehicles in corresponding water slides to race play participants riding an opposing ride vehicle.

2. The competitive play structure of claim 1, wherein the first control area is positioned adjacent the first water slide and the second control area is positioned adjacent the second water slide.

3. The competitive play structure of claim 1 additionally comprising an electronic controller adapted to receive a signal from an actuator and to send an operating signal to the corresponding play effect.

4. The competitive play structure of claim 3, wherein each water slide comprises a magnitude-increasing actuator positioned relative to the slide path so that ride participants on the slide path must affirmatively move their bodies to trigger the actuator, and the magnitude-increasing actuator electronically communicates with the controller so that the controller signals an associated play effect to increase in magnitude when the magnitude-increasing actuator is triggered.

5. The competitive play structure of claim 3, wherein each water slide comprises a magnitude-decreasing actuator positioned relative to the slide path so that the actuator will be triggered by ride participants on the slide path unless the ride participants affirmatively move their bodies to avoid triggering the actuator, and the magnitude-decreasing actuator electronically communicates with the controller so that the controller signals an associated play effect to decrease in magnitude when the magnitude-decreasing actuator is triggered.

6. A water slide play structure for entertaining play participants, comprising:

first and second water slides each comprising a start point, a finish point, and a path defined therebetween, each water slide adapted to conduct a flow of water along at least a portion of the path and to convey a play participant riding along the path from the start point to the finish point;

a competition zone comprising a first control platform and a second control platform, and the first and second water slides pass through the competition zone and are substantially identical to each other within the competition zone, the first control platform positioned adjacent the first water slide and the second control platform positioned adjacent the second water slide;

at least one aiding or hindering play effect associated with each slide within the competition zone and adapted to promote or hinder progress of the play participant riding along the path; and at least one aiding or hindering effect controller associated with each slide within the competition zone and adapted to actuate the aiding or hindering play effect.

7. The water slide play structure of claim 6, wherein the aiding or hindering effect controller is positioned relative to the water slide path so that the play participant riding along the path can trigger the controller.

8. The water slide play structure of claim 7 additionally comprising a second water slide, the second water slide being substantially similar to the first water slide.

9. The water slide play structure of claim 8, wherein the aiding or hindering effect controller for the first water slide is positioned so as to be actuable by a play participant riding along the path of the second water slide, and the aiding or hindering effect controller for the second water slide is positioned so as to be actuable by a play participant riding along the path of the first water slide.

10. The water slide play structure of claim 6 additionally comprising a platform positioned adjacent the water slide, and the aiding or hindering effect controller is positioned on the platform.

11. The water slide play structure of claim 6, wherein at least one aiding effect controller corresponding to the at least one aiding effect in the first water slide is positioned on the first control platform and at least one hindering effect controller corresponding to the at least one hindering effect in the first water slide is positioned on the second control platform.

12. The water slide play structure of claim 11, wherein at least one of the aiding effects comprises a push jet, the push jet adapted to direct a flow of water in a direction substantially downstream.

13. The water slide play structure of claim 12, wherein the push jet is actuable for a limited period of time.

14. The water slide play structure of claim 11, wherein at least one of the aiding effects comprises a retractable rail.

15. The water slide play structure of claim 11, wherein at least one of the hindering effects comprises a reverse jet, the reverse jet adapted to direct a flow of water in a direction substantially upstream.

16. The water slide play structure of claim 11, wherein at least one of the hindering effects comprises a geyser jet adapted to direct a flow of water upwardly from the water slide path.

17. The water slide play structure of claim 6, wherein each of the water slides comprises a relatively deep portion within the competition zone, the deep portion having an upstream end and a downstream end, a weir being provided at the downstream end, and water from the water slide flows into the deep portion at the upstream end and out of the deep portion over the weir at the downstream end.

18. The water slide play structure of claim 17, wherein a drain is provided at the downstream end of the deep portion, and a recirculation system moves water from the drain to an inlet port at the upstream end of the deep portion so that a current flows in the deep portion from the upstream end to the downstream end.

19. The water slide play structure of claim 6, wherein at least one displacement pump is provided on the first control platform, and the at least one displacement pump is adapted to pump water from the second water slide to the first water slide when the pump is actuated.

20. The water slide play structure of claim 19, wherein the displacement pump is manually actuable by a play participant on the first control platform.

21. The water slide play structure of claim 6, wherein a plurality of the aiding and hindering effects comprise water effects.

22. The water slide play structure of claim 21, wherein each of the aiding and hindering water effects comprises a dedicated pump communicating with a source of water.

23. The water slide play structure of claim 22, wherein the dedicated pumps are adapted to increase or decrease pumping volume upon receiving a signal from a corresponding controller.

24. The water slide play structure of claim 21, wherein a pump supplies water under pressure to a plurality of the water effects.

25. The water slide play structure of claim 6 additionally comprising a timer for measuring elapsed time between a play participant passing a start point and a finish point.

26. The water slide play structure of claim 25, additionally comprising a display for displaying each play participant's elapsed time.

27. A water slide play structure for entertaining play participants, comprising:

water slide comprising a start point, a finish point, and a path defined therebetween, the water slide adapted to conduct a flow of water along at least a portion of the path and to convey a play participant riding along the path from the start point to the finish point;

an aiding or hindering play effect adapted to promote or hinder progress of the play participant riding along the path;

an aiding or hindering effect controller adapted to actuate the aiding or hindering play effect; and a secondary aiding controller, the secondary aiding controller adapted to increase the magnitude of the aiding play effect when actuated.

* * * * *